US009650588B2

(12) United States Patent
Greaves et al.

(10) Patent No.: US 9,650,588 B2
(45) **Date of Patent: *May 16, 2017**

(54) COMPOSITIONS OF HYDROCARBON OILS AND OIL SOLUBLE PAGS PRODUCED BY DMC CATALYSTS

(75) Inventors: Martin R. Greaves, Baar (CH); Ronald Van Voorst, Vogelwaarde (NL); Marinus Meertens, Terneuzen (NL)

(73) Assignee: Dow Global Technologies LLC, Midland, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/350,094

(22) PCT Filed: Sep. 14, 2012

(86) PCT No.: PCT/US2012/055363

§ 371 (c)(1),
(2), (4) Date: Apr. 7, 2014

(87) PCT Pub. No.: WO2013/062682

PCT Pub. Date: May 2, 2013

(65) Prior Publication Data

US 2014/0249063 A1 Sep. 4, 2014

Related U.S. Application Data

(60) Provisional application No. 61/552,641, filed on Oct. 28, 2011.

(51) Int. Cl.

| | |
|---|---|
| ***C10M 107/34*** | (2006.01) |
| ***C10M 169/04*** | (2006.01) |
| ***C10M 111/04*** | (2006.01) |

(52) U.S. Cl.

CPC ..... *C10M 169/04* (2013.01); *C10M 111/04* (2013.01); *C10M 169/041* (2013.01);
(Continued)

(58) Field of Classification Search

CPC ..... C10M 2209/104
(Continued)

(56) References Cited

U.S. PATENT DOCUMENTS

| | | | |
|---|---|---|---|
| 3,829,505 | A | 8/1974 | Johnston et al. |
| 5,158,922 | A | 10/1992 | Hinney et al. |

(Continued)

FOREIGN PATENT DOCUMENTS

| | | |
|---|---|---|
| WO | WO2004/087789 | 10/2004 |
| WO | WO2011/011656 | 1/2011 |

OTHER PUBLICATIONS

PCT Search Report dated May 12, 2012; from PCT counterpart Application No. PCT/US2012/055363.

PCT International Preliminary Report on Patentability (IPRP) dated May 8, 2014; from PCT counterpart Application No. PCT/US2012/055363.

(Continued)

*Primary Examiner* — Vishal Vasisth

(74) *Attorney, Agent, or Firm* — Brooks, Cameron & Huebsch, PLLC

(57) ABSTRACT

A lubricant composition comprising a Group I, II, III or IV hydrocarbon oil and a polyalkylene glycol, the polyalkylene glycol having been prepared by reacting a $C_8$-$C_{20}$ alcohol and a mixed butylene oxide/propylene oxide feed using a double metal cyanide catalyst catalyzed oxyalkylation process, and wherein the lubricant composition remains clear and shows no phase separation at temperatures equal to and greater than the pour point of the hydrocarbon oil is provided. A method for making a lubricant composition is also provided.

8 Claims, 2 Drawing Sheets

(52) U.S. Cl.
CPC ..... *C10M 2203/1006* (2013.01); *C10M 2203/1025* (2013.01); *C10M 2205/0285* (2013.01); *C10M 2209/105* (2013.01); *C10M 2209/1055* (2013.01); *C10N 2220/021* (2013.01); *C10N 2230/70* (2013.01); *C10N 2270/00* (2013.01)

(58) Field of Classification Search
USPC ..... 508/579
See application file for complete search history.

(56) References Cited

U.S. PATENT DOCUMENTS

| | | | | |
|---|---|---|---|---|
| 5,470,813 | A | 11/1995 | Le-Khac | |
| 5,482,908 | A | 1/1996 | Le-Khac | |
| 5,783,513 | A | 7/1998 | Combs et al. | |
| 7,811,958 | B2 | 10/2010 | Bohres et al. | |
| 2012/0108482 | A1* | 5/2012 | Greaves et al. | 508/579 |

OTHER PUBLICATIONS

EP Office Action dated Apr. 22, 2014; from EP counterpart Application No. 12772841.8.
Instructions to EP Office Action dated Aug. 4, 2014; from EP counterpart Application No. 12772841.8.
Response to Chinese Office Action filed Jun. 19, 2015 for counterpart Chinese Application No. 201280051900.8, 3 pages.
Chinese Office Action dated Feb. 4, 2015 for counterpart Chinese Application No. 201280051900.8, 4 pages.

* cited by examiner

COMPOSITIONS OF HYDROCARBON OILS AND OIL SOLUBLE PAGS PRODUCED BY DMC CATALYSTS

FIELD OF INVENTION

The instant invention relates to a composition, method of producing the same, articles made therefrom, and methods for making such articles.

BACKGROUND OF THE INVENTION

Conventional polyalkylene glycols (PAG) are widely used in the lubricants industry and are typically based on ethylene oxide (EO) or propylene oxide (PO) homopolymers or EO/PO co-polymers. Such PAGs provide good properties, such as excellent viscosity index and low temperature properties, which are important for certain lubricant applications. However, it is well known that EO, PO, or EO/PO based polymers are not oil miscible.

Oil soluble PAGs (OSP) based on a fatty alcohol initiator (e.g., dodecanol) with a mixed PO/butylene oxide (BO) feed using a potassium hydroxide catalyst have been developed. The higher viscosity ranges of such OSPs do not exhibit optimal solubility in API (American Petroleum Institute) Group III and IV base oils. In addition, it would be desirable to have OSPs across a large viscosity range which exhibits good solubility across a wide temperature range from low temperatures (e.g. −15° C.) to high temperatures (e.g., 80° C.), which is representative of lubricants in operation.

SUMMARY OF THE INVENTION

The invention is a lubricant composition and method of preparing same.

A first embodiment of the invention is a lubricant composition comprising: a Group I, II, III or IV hydrocarbon oil; and a polyalkylene glycol, the polyalkylene glycol having been prepared by reacting a $C_8$-$C_{20}$ alcohol and a mixed butylene oxide/propylene oxide feed using a double metal cyanide catalyst catalyzed oxyalkylation process; wherein the lubricant composition remains clear and shows no phase separation at temperatures equal to and greater than the pour point of the hydrocarbon oil.

A second embodiment of the invention is a method of preparing a lubricant composition comprising blending at least (a) a Group I, II, III or IV hydrocarbon oil, and (b) a polyalkylene glycol prepared by reacting a $C_8$-$C_{20}$ alcohol and a mixed butylene oxide/propylene oxide feed in a double metal cyanide catalyst catalyzed oxyalkylation process, under conditions such that the hydrocarbon oil and the polyalkylene glycol are soluble with one another.

BRIEF DESCRIPTION OF THE DRAWINGS

For the purpose of illustrating the invention, there is shown in the drawings a form that is exemplary; it being understood, however, that this invention is not limited to the precise arrangements and instrumentalities shown.

DETAILED DESCRIPTION OF THE INVENTION

Figure 1:
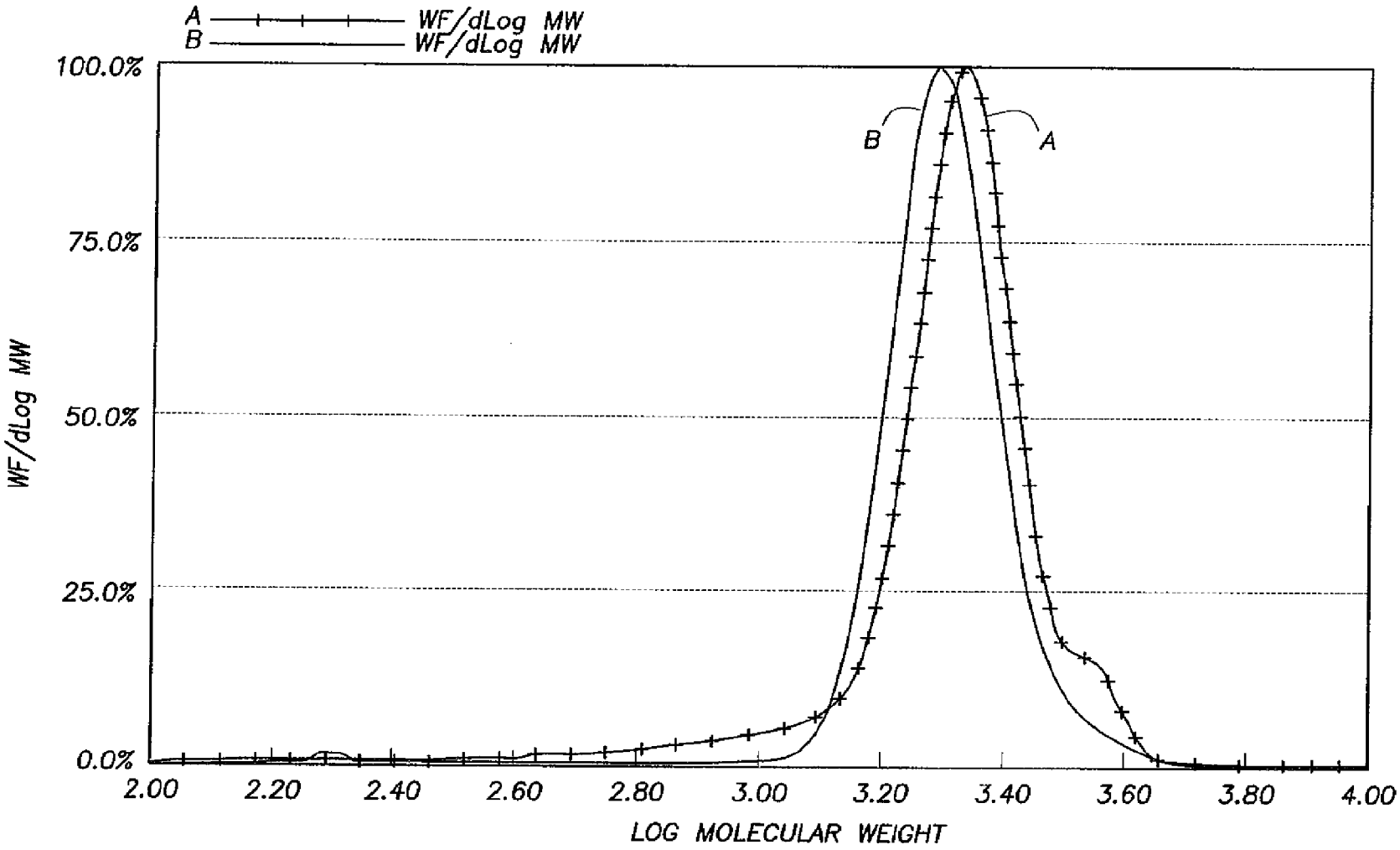
FIG. 1 is a graph of Log Weight Average Molecular Weight vs. a normalization of the concentration of a molecular weight fraction for each of Inventive Example 1 and Comparative Example 4.

The instant invention is a lubricant composition and a method of making a lubricant composition.

The composition according to the present invention comprises one or more base oils selected from the group consisting of Group I, II, III or IV hydrocarbon oils and a polyalkylene glycol, the polyalkylene glycol having been prepared by reacting a $C_8$-$C_{20}$ alcohol and a mixed butylene oxide/propylene oxide feed using a double metal cyanide catalyst catalyzed oxyalkylation process, and wherein the lubricant composition remains clear and shows no phase separation at temperatures equal to and greater than the pour point of the hydrocarbon oil.

The method of preparing a lubricant composition according to the present invention comprises blending at least (a) a Group I, II, III, or IV hydrocarbon oil, and (b) a polyalkylene glycol prepared by reacting a $C_8$-$C_{20}$ alcohol and a mixed butylene oxide/propylene oxide feed in a double metal cyanide catalyst catalyzed oxyalkylation process, under conditions such that the hydrocarbon oil and the polyalkylene glycol are soluble with one another.

All individual values and subranges from $C_8$-$C_{20}$ alcohols are included herein and disclosed herein. For example, the alcohols used can be from a lower limit of $C_8$, $C_9$, $C_{10}$, $C_{11}$, $C_{12}$, $C_{13}$, $C_{14}$, $C_{15}$, $C_{16}$, $C_{17}$, $C_{18}$, or $C_{19}$ to an upper limit of $C_9$, $C_{10}$, $C_{11}$, $C_{12}$, $C_{13}$, $C_{14}$, $C_{15}$, $C_{16}$, and $C_{17}$. $C_{18}$, $C_{19}$ or $C_{20}$. For example, the alcohols used in producing the polyalkylene glycol may be in the range of from $C_8$-$C_{20}$ alcohols, or in the alternative, the alcohols used in producing the polyalkylene glycol may be in the range of from $C_8$-$C_{12}$ alcohols, or in the alternative, the alcohols used in producing the polyalkylene glycol may be in the range of from $C_{10}$-$C_{14}$ alcohols. In a particular embodiment, the alcohol is 2-ethylhexanol, dodecanol, or a mixture thereof.

Double metal cyanide catalysts useful in various embodiments of the invention are not limited by the combination of metals in the catalyst. For example, the metals used in the double metal cyanide catalysts may be selected from the group consisting of Zn(II), Fe(II), Ni(II), Mn(II), Co(II), Sn(II), Pb(II), Fe(III), Mo(IV), Mo(VI), AI(III), V(V), V(IV), Sr(II), W(IV), W(VI), Cu(II), and Cr(III). Methods of making double metal cyanide catalysts are known in the art, such as the methods disclosed in U.S. Pat. Nos. 3,829,505, 5,158,922, 5,470,813, 5,482,908, 5,783,513, and 7,811,958. In some embodiments, the double metal cyanide catalyst contains cobalt and zinc. In a specific embodiment, the double metal cyanide catalyst contains from 10 to 11 wt % cobalt and from 23 to 25 wt % zinc. An exemplary commercial DMC catalyst useful in embodiments of the invention is ARCOL CATALYST 3 (Dry), having a cobalt content of 10.5 wt % and a zinc content of 23.9 wt %, available from Bayer Material Sciences.

In some embodiments of the invention, the hydrocarbon oil and the polyalkylene glycol are soluble with one another for at least one week under at least one temperature selected from temperatures from 80° C. to −15° C.

In some embodiments, the inventive lubricant composition comprises from 99.5 to 0.5 weight percent of the hydrocarbon oil and from 0.5 to 99.5 weight percent of the polyalkylene glycol. All individual values and subranges from 99.5 to 0.5 weight percent hydrocarbon oil are included herein and disclosed herein. For example, the amount of the hydrocarbon oil that may be present in the lubricant composition can be from a lower limit of 0.5, 15, 27, 39, 45, 56, 67, 78, 88, 91, or 99 weight percent to an upper limit of 10, 25, 35, 45, 55, 65, 74, 83, 90, 95, or 99.5 weight percent. For example, the amount of hydrocarbon oil in the lubricant composition may be in the range of from 0.5 to 99.5 weight percent, or in the alternative, the amount of hydrocarbon oil in the lubricant composition may be in the range of from 1 to 99 weight percent, or in the alternative, the amount of hydrocarbon oil in the lubricant composition may be in the range of from 25 to 75 weight percent, or in the alternative, the amount of hydrocarbon oil in the lubricant composition may be in the range of from 40 to 60 weight percent.

Likewise, all individual values and subranges from 0.5 to 99.5 weight percent polyalkylene glycol are included herein and disclosed herein; for example, the amount of the polyalkylene glycol that may be present in the lubricant composition can be from a lower limit of 0.5, 10, 25, 35, 45, 55, 65, 75, 85, 95, or 99 weight percent to an upper limit of 15, 26, 37, 48, 59, 63, 74, 85, 96, or 99.5 weight percent. For example, the amount of polyalkylene glycol in the lubricant composition may be in the range of from 0.5 to 99.5 weight percent, or in the alternative, the amount of polyalkylene glycol in the lubricant composition may be in the range of from 1 to 99 weight percent, or in the alternative, the amount of polyalkylene glycol in the lubricant composition may be in the range of from 25 to 75 weight percent, or in the alternative, the amount of hydrocarbon oil in the lubricant composition may be in the range of from 40 to 60 weight percent.

In certain embodiments of the inventive lubricant composition, the polyalkylene comprises a ratio of units derived from butylene oxide to the ratio of units derived from propylene oxide is from 3:1 to 1:1. All individual values and subranges from 3:1 to 1:1 are included herein and disclosed herein; for example, the ratio of units derived from butylene oxide to the ratio of units derived from propylene oxide can be, for example, 3:1, 2.7:1, 2.5:1, 2.3:1, 2.1:1, 1.9:1, 1.7:1, 1.5:1, 1.3:1, 1.1:1 or 1:1.

In some embodiments, the polyalkylene glycol has a carbon to oxygen ratio of at least 3.5:1. All individual values and subranges of at least 3.5:1 are included herein and disclosed herein; for example, the polyalkylene glycol can have a carbon to oxygen ratio of at least 3.5:1, or in the alternative, the polyalkylene glycol can have a carbon to oxygen ratio of at least 4:1, or in the alternative, the polyalkylene glycol can have a carbon to oxygen ratio of at least 5:1, or in the alternative, the polyalkylene glycol can have a carbon to oxygen ratio of at least 6:1.

In some embodiments of the invention, the polyalkylene glycol has an unsaturation level less than 0.05 meq/g. All individual values and subranges from less than 0.05 meq/g are included herein and disclosed herein; for example, the polyalkylene glycol can have an unsaturation level less than 0.04 meq/g, or in the alternative, the polyalkylene glycol can have an unsaturation level less than 0.03 meq/g.

In certain embodiments of the invention, the polyalkylene glycol has a kinematic viscosity of greater than 100 cSt at 40° C. All individual values and subranges from greater than 100 cSt at 40° C. are included herein and disclosed herein; for example, the polyalkylene glycol can have a kinematic viscosity of greater than 150 cSt at 40° C., or in the alternative, the polyalkylene glycol can have a kinematic viscosity of greater than 200 cSt at 40° C.

In a particular embodiment of the invention, the polyalkylene glycol has a kinematic viscosity of >100 cSt at 40° C. and comprises a ratio of units derived from butylene oxide to units derived from propylene oxide from 3:1 to 1:1.

In certain embodiments, the polyalkylene glycol comprises less than 10 wt % combined allyl alcohol and propenyl alcohol initiated polyglycol. All individual values and subranges from less than 10 wt % are included herein and disclosed herein; for example, the amount of ally alcohol or propenyl alcohol initiated in the polyalkylene glycol can be from an upper limit of 10, 9, 8, 7, 6 or 5 wt %.

One embodiment of the invention is a lubricant composition comprising: a Group I, II, III or IV hydrocarbon oil; and a polyalkylene glycol, the polyalkylene glycol having been prepared by reacting a $C_8$-$C_{20}$ alcohol and a mixed butylene oxide/propylene oxide feed using a double metal cyanide catalyst catalyzed oxyalkylation process; wherein the lubricant composition remains clear and shows no phase separation at temperatures equal to or greater than the pour point of the hydrocarbon oil.

Another embodiment of the invention is a method of preparing a lubricant composition comprising blending at least (a) a Group I, II, III, or IV hydrocarbon oil, and (b) a polyalkylene glycol prepared by reacting a $C_8$-$C_{20}$ alcohol and a mixed butylene oxide/propylene oxide feed in a double metal cyanide catalyst catalyzed oxyalkylation process, under conditions such that the hydrocarbon oil and the polyalkylene glycol are soluble with one another.

In an alternative embodiment, the instant invention provides a lubricant composition, and method of making same, in accordance with any of the preceding embodiments, except that the lubricant composition comprises from 99.5 to 0.5 weight percent of the hydrocarbon oil and from 0.5 to 99.5 weight percent of the polyalkylene glycol.

In an alternative embodiment, the instant invention provides a lubricant composition, and method of making same, in accordance with any of the preceding embodiments, except that the polyalkylene glycol comprises a ratio of units derived from butylene oxide to the ratio of units derived from propylene oxide is from 3:1 to 1:1.

In an alternative embodiment, the instant invention provides a lubricant composition, and method of making same, in accordance with any of the preceding embodiments, except that the alcohol is a $C_8$-$C_{12}$ alcohol.

In an alternative embodiment, the instant invention provides a lubricant composition, and method of making same, in accordance with any of the preceding embodiments, except that the alcohol is 2-ethylhexanol, dodecanol, or a mixture thereof.

In an alternative embodiment, the instant invention provides a lubricant composition, and method of making same, in accordance with any of the preceding embodiments, except that the hydrocarbon oil and the polyalkylene glycol are soluble with one another for at least one week under at least one temperature selected from temperatures from 80° C. to −15° C.

In an alternative embodiment, the instant invention provides a lubricant composition, and method of making same, in accordance with any of the preceding embodiments, except that the polyalkylene glycol comprises a ratio of units derived from butylene oxide to the ratio of units derived from propylene oxide is 1:1.

In an alternative embodiment, the instant invention provides a lubricant composition, and method of making same, in accordance with any of the preceding embodiments, except that the polyalkylene glycol has a carbon to oxygen ratio of at least 3.5:1.

In an alternative embodiment, the instant invention provides a lubricant composition, and method of making same, in accordance with any of the preceding embodiments, except that the polyalkylene glycol has a carbon to oxygen ratio that is from 3:1 to 6:1.

In an alternative embodiment, the instant invention provides a lubricant composition, and method of making same, in accordance with any of the preceding embodiments, except that the polyalkylene glycol has an unsaturation level <0.05 meq/g.

In an alternative embodiment, the instant invention provides a lubricant composition, and method of making same, in accordance with any of the preceding embodiments, except that the polyalkylene glycol has a kinematic viscosity of >100 cSt at 40° C.

In an alternative embodiment, the instant invention provides a lubricant composition, and method of making same, in accordance with any of the preceding embodiments, except that the polyalkylene glycol has a kinematic viscosity of >100 cSt at 40° C. and comprises a ratio of units derived from butylene oxide to units derived from propylene oxide from 3:1 to 1:1.

In an alternative embodiment, the instant invention provides a lubricant composition consisting essentially of a Group I, II, III or IV hydrocarbon oil; and a polyalkylene glycol, the polyalkylene glycol having been prepared by reacting a $C_8$-$C_{20}$ alcohol and a mixed butylene oxide/propylene oxide feed using a double metal cyanide catalyst catalyzed oxyalkylation process; wherein the lubricant composition remains clear and shows no phase separation at temperatures equal to or greater than the pour point of the hydrocarbon oil.

EXAMPLES

The following examples illustrate the present invention but are not intended to limit the scope of the invention. The examples of the instant invention demonstrate that lubricant compositions using higher viscosity PAGs formed using DMC catalysts exhibit good solubility in all groups of base hydrocarbon oils, including Group III and IV hydrocarbon oils and at all temperatures equal to or greater than the pour point of the base oil.

Comparative Example 1 is a polyalkylene glycol which was produced from a dodecanol initiator with a mix feed of PO/BO (50/50 w/w) using KOH as the catalyst and having a viscosity of 32 cSt at 40° C.

Comparative Example 2 is a polyalkylene glycol which was produced from a dodecanol initiator with a mix feed of PO/BO (50/50 w/w) using KOH as the catalyst and having a viscosity of 46 cSt at 40° C.

Comparative Example 3 is a polyalkylene glycol which was produced from a dodecanol initiator with a mix feed of PO/BO (50/50 w/w) using KOH as the catalyst and having a viscosity of 68 cSt at 40° C.

Comparative Example 4 is a polyalkylene glycol which was produced using a dodecanol initiator and KOH as catalyst with a mix feed of PO/BO (50/50 w/w) having a viscosity of 150 cSt at 40° C.

Comparative Example 5 is a polyalkylene glycol which was produced using a dodecanol initiator and KOH catalyst with a mix feed of PO/BO (50/50 w/w) and a viscosity of 220 cSt at 40° C.

Inventive Example 1 is a polyalkylene glycol which was produced using a dodecanol initiator and a DMC catalyst, ARCOL CATALYST 3 (Dry), commercially available from Bayer Material Sciences with a mixed feed of PO/BO (50/50 w/w) and having a viscosity of 153 cSt at 40° C.

Inventive Example 2 is a polyalkylene glycol which was produced using a dodecanol initiator and a DMC catalyst, ARCOL CATALYST 3 (Dry), with a mix feed of PO/BO (50/50 w/w) and having a viscosity of 216 cSt at 40° C.

The polyalkylene glycols of Comparative Examples 1-5 were prepared using the following alkoxylation procedure:

General Procedure for Alkoxylation Using Potassium Hydroxide as Catalyst

In a stainless steel reactor, equipped with a stirrer, a vacuum system and a dosing system for alkylene oxides, the required quantity of the initiator dodecanol was loaded. To this, the required quantity of potassium hydroxide was added. The reactor was closed, the air in the reactor was replaced with nitrogen and the reactor was heated to 100° C., at which temperature the water present was removed by means of vacuum.

Next, the reactor was heated to 130° C. At this temperature, the needed quantity of alkylene oxides (as a 50/50 PO/BO mix feed by weight) was gradually added over time. Once all oxide has been added and has reacted away, the catalyst was removed by means of filtration using a magnesium silicate filter bed.

The polyalkylene glycols of Inventive Examples 1-2 were produced using the following alkoxylation procedure.

General Procedure for Alkoxylation Using DMC as Catalyst

A stainless steel reactor, equipped with a stirrer, a vacuum system and a dosing system for alkylene oxides was used. The required quantity of the initiator dodecanol was mixed with the required quantity of DMC catalyst. A small amount of phosphoric acid was added at this time to reduce alkalinity if needed. This mixture was loaded in the reactor, the reactor was closed, the air present in the reactor was replaced with nitrogen and the reactor was heated to 140° C.

At this temperature, 10-20% by weight of the total needed quantity of alkylene oxides (as a 50/50 PO/BO mix feed by weight) was added to activate the DMC catalyst. After the activation, the remaining amount of alkylene oxides was gradually added over time. Once all oxide had been added and had reacted, the catalyst could either be removed (neutralization by a base, followed by filtration) or could be left in the product. In forming the Inventive Examples, the catalyst was not removed from the product.

Table 1 provides the data for testing of the polyalkylene glycols of Comparative Examples 4-5 and Inventive Examples 1-2 for a variety of polymer characteristics.

TABLE 1

| Method | Comp. Ex. 4 | Inv. Ex. 1 | Comp. Ex. 5 | Inv. Ex. 2 |
|---|---|---|---|---|
| Viscosity at 40° C., cSt | 150 | 153 | 243 | 216 |
| Viscosity at 100° C., cSt | 23.4 | 23.2 | 35.8 | 33.3 |
| Viscosity index | 187 | 182 | 197 | 201 |
| % OH, wt % | 0.91 | 0.83 | 0.72 | 0.66 |
| Total Unsaturation, meq/g | 0.134 | 0.0301 | 0.153 | 0.0287 |
| Actual/theoretical weight average molecular weight, % t | 69.0 | 96.9 | 48.5 | 96.2 |
| Unsaturation/OH, % | 25.0 | 6.0 | 36.4 | 7.5 |

The polyalkylene glycols of Comparative Examples 1-5 and Inventive Examples 1-2 were tested for solubility (or blend stability) in a variety of hydrocarbon base oils at a number of weight ratios of base oil to PAG. The results of this testing are shown in Tables 2-4.

A Group I conventional solvent refined base oil, commercially available from Total Petrochemicals, Inc. under the name 150SN, was used.

A Group III oil used was NEXBASE 3080 which is a hydroprocessed mineral oil base fluid, available from Neste, and having a pour point of −12° C.

A first Group IV oil used was NEXBASE 2004 which is a polyalphaolefin base available from Neste, having a kinematic viscosity at 100° C. of 4 cSt and a pour point of −69° C.

A second Group IV oil used was SPECTRASYN 8, which is a polyalphaolefin base oil available from Exxon Mobil Chemicals, having a kinematic viscosity at 100° C. of 8 cSt and a pour point of −54° C.

The results of such testing for Comparative Example 4 and Inventive Example 1 are shown in Table 2. As can be seen from Table 2, when Comparative Example 4 and Inventive Example 1 are blended in Group I hydrocarbon oil, essentially no differences in solubility were observed. Both Comparative Example 4 and Inventive Example 1 show excellent solubilities across the blend ratio range. At −15° C. all the blends were turbid. However, such turbidity was expected because the hydrocarbon base oil had a pour point of −12° C.

As can further be seen in Table 2, when Comparative Example 4 and Inventive Example 1 are blended in Group III hydrocarbon oil, solubilities Inventive Example 1 were improved over those of Comparative Example 4 at levels in the range 10 to 50 wt % of PAG in the base oil. At −15° C., all of the blends were turbid as anticipated because the base oil had a pour point of −12° C.

As can further be seen in Table 2, when Comparative Example 4 and Inventive Example 1 are blended in a SPECTRASYN-8, Inventive Example 1 showed improvements in solubility at levels of 10 weight %, 25 weight % and 90 weight % of the polyalkylene glycol.

As can further be seen in Table 2, when Comparative Example 4 and Inventive Example 1 are blended in a NEXBASE 2004, Inventive Example 1 showed improvements in solubility at levels of 50 weight % of the polyalkylene glycol at −15° C.

The results of such testing for Comparative Example 5 and inventive Example 2 are shown in Table 3. As can be seen from Table 3, when Comparative Example 5 and Inventive Example 2 are blended in Group I hydrocarbon oil, essentially no differences in solubility were observed. Both Comparative Example 5 and Inventive Example 2 show excellent solubilities across the blend ratio range. At −15° C. all the blends were turbid; however, such turbidity was expected because the hydrocarbon base oil had a pour point of −12° C.

As can be further seen from Table 3, when Comparative Example 5 and Inventive Example 2 are blended in the Group III hydrocarbon oil, solubilities of Inventive Example 2 were improved over those of Comparative Example 5 at levels in the range 10 to 50 wt % of PAG in the base oil. At −15° C., all of the blends were turbid as anticipated because the base oil had a pour point of −12° C.

As can further be seen in Table 3, when Comparative Example 5 and Inventive Example 2 are blended in a SPECTRASYN-8 base oil, Inventive Example 2 showed improvements in solubility at levels of 75 weight % and 90 weight % of the polyalkylene glycol.

Table 4 provides solubility data for Comparative Examples 1-3. Each of Comparative Examples 1-3 exhibits excellent solubilities at all ratios except in Group I and III base oils at −15° C. (which was expected because the hydrocarbon base oils have a pour point of −12° C.).

TABLE 2

| | OIL/OSP | Inventive Example 1 | | | Comparative Example 4 | | |
|---|---|---|---|---|---|---|---|
| Oil | w/w | 25° C. | 80° C. | −15° C. | 25° C. | 80° C. | −15° C. |
| Group I | 90/10 | clear | clear | turbid | clear | clear | turbid |
| 150 Solvent | 75/25 | clear | clear | turbid | | | |
| Neutral | 50/50 | clear | clear | turbid | clear | clear | turbid |
| | 25/75 | clear | clear | turbid | | | |
| | 10/90 | clear | clear | turbid | clear | clear | turbid |
| Group III | 90/10 | clear | clear | turbid | turbid | turbid | turbid |
| NEXBASE | 75/25 | clear | clear | turbid | 2 phases | 2 phases | 2 phases |
| 3080 | 50/50 | clear | clear | 2 phases | 2 phases | 2 phases | 2 phases |
| | 25/75 | clear | clear | 2 phases | clear | clear | 2 phases |
| | 10/90 | clear | clear | turbid | clear | clear | turbid |
| Group IV | 90/10 | clear | clear | clear | 2 phases | turbid | turbid |
| SPECTRASYN 8 | 75/25 | clear | clear | clear | 3 phases | turbid | turbid |
| | 50/50 | clear | 2 phases | clear | 2 phases | 2 phases | 2 phases |
| | 25/75 | clear | 2 phases | clear | turbid | turbid | 2 phases |
| | 10/90 | clear | clear | clear | clear | clear | turbid |
| Group IV | 90/10 | clear | clear | clear | clear | clear | clear |
| NEXBASE | 75/25 | clear | clear | clear | | | |
| 2004 | 50/50 | clear | clear | clear | clear | clear | 2 phases |
| | 25/75 | clear | clear | clear | | | |
| | 10/90 | clear | clear | clear | clear | clear | clear |

TABLE 3

| | OIL/OSP | Inventive Example 2 | | | Comparative Example 5 | | |
|---|---|---|---|---|---|---|---|
| Oil | w/w | 25° C. | 80° C. | −15° C. | 25° C. | 80° C. | −15° C. |
| Group I | 90/10 | clear | Clear | turbid | clear | clear | 2 phases |
| 150 Solvent | 75/25 | clear | Clear | turbid | | | |
| Neutral | 50/50 | clear | clear | turbid | clear | clear | turbid |
| | 25/75 | clear | clear | turbid | | | |
| | 10/90 | clear | clear | turbid | clear | clear | turbid |

TABLE 3-continued

| Oil | OIL/OSP w/w | Inventive Example 2 25° C. | 80° C. | −15° C. | Comparative Example 5 25° C. | 80° C. | −15° C. |
|---|---|---|---|---|---|---|---|
| Group III | 90/10 | clear | clear | 2 phases | turbid | turbid | turbid |
| NEXBASE 3080 | 75/25 | clear | clear | | | | |
| | 50/50 | clear | clear | 2 phases | 2phases | 2phases | 2phases |
| | 25/75 | clear | clear | 2 phases | clear | clear | 2phases |
| | 10/90 | clear | clear | turbid | clear | clear | turbid |
| Group IV | 90/10 | turbid | turbid | turbid | turbid | turbid | turbid |
| SPECTRASYN-8 | 75/25 | 2 phases | 2 phases | 2 phases | turbid | turbid | turbid |
| | 50/50 | 2 phases | 2 phases | 2 phases | 2 phases | 2 phases | 2 phases |
| | 25/75 | clear | clear | 2 phases | 2 phases | turbid | 2 phases |
| | 10/90 | clear | clear | turbid | clear | clear | turbid |
| Group IV | 90/10 | clear | clear | clear | clear | clear | clear |
| NEXBASE 2004 | 75/25 | clear | clear | clear | | | |
| | 50/50 | clear | clear | 2 phases | clear | clear | 2 phases |
| | 25/75 | clear | clear | clear | | | |
| | 10/90 | clear | clear | clear | clear | clear | clear |

TABLE 4

| Oil | OIL/OSP w/w | Comparative Example 1 25° C. | 80° C. | −15° C. |
|---|---|---|---|---|
| Group I | 90/10 | clear | clear | turbid |
| 150 Solvent | 75/25 | | | |
| Neutral | 50/50 | clear | clear | turbid |
| | 25/75 | | | |
| | 10/90 | clear | clear | turbid |
| Group III | 90/10 | clear | clear | turbid |
| NEXBASE 3080 | 75/25 | clear | clear | turbid |
| | 50/50 | clear | clear | turbid |
| | 25/75 | clear | clear | turbid |
| | 10/90 | clear | clear | turbid |
| Group IV | 90/10 | clear | clear | clear |
| SPECTRASYN-8 | 75/25 | clear | clear | clear |
| | 50/50 | clear | clear | clear |
| | 25/75 | clear | clear | clear |
| | 10/90 | clear | clear | clear |
| Group IV | 90/10 | clear | clear | clear |
| NEXBASE 2004 | 75/25 | | | |
| | 50/50 | clear | clear | clear |
| | 25/75 | | | |
| | 10/90 | clear | clear | clear |

| Oil | OIL/OSP w/w | Comparative Example 2 25° C. | 80° C. | −15° C. | Comparative Example 3 25° C. | 80° C. | −15° C. |
|---|---|---|---|---|---|---|---|
| Group I | 90/10 | clear | clear | turbid | clear | clear | turbid |
| 150 Solvent | 75/25 | clear | clear | turbid | | | |
| Neutral | 50/50 | clear | clear | turbid | clear | clear | turbid |
| | 25/75 | clear | clear | turbid | | | |
| | 10/90 | clear | clear | turbid | clear | clear | turbid |
| Group III | 90/10 | clear | clear | turbid | clear | clear | turbid |
| NEXBASE | 75/25 | clear | clear | turbid | | | |
| 3080 | 50/50 | clear | clear | turbid | clear | clear | turbid |
| | 25/75 | clear | clear | turbid | clear | clear | turbid |
| | 10/90 | clear | clear | turbid | clear | clear | turbid |
| Group IV | 90/10 | clear | clear | clear | clear | clear | clear |
| SPECTRAS | 75/25 | clear | clear | clear | clear | clear | clear |
| YN-8 | 50/50 | clear | clear | clear | clear | clear | clear |
| | 25/75 | clear | clear | clear | clear | clear | clear |
| | 10/90 | clear | clear | clear | clear | clear | clear |
| Group IV | 90/10 | clear | clear | clear | clear | clear | clear |
| NEXBASE | 75/25 | clear | clear | clear | | | |
| 2004 | 50/50 | clear | clear | clear | clear | clear | clear |
| | 25/75 | clear | clear | clear | | | |
| | 10/90 | clear | clear | clear | clear | clear | clear |

Table 5 illustrates the weight percent of combined allyl and propenyl alcohol initiated polyglycol in the product of each of Comparative Examples 1-5.

TABLE 5

| | Comp. Ex. 1 | Comp. Ex. 2 | Comp. Ex. 3 | Comp. Ex. 4 | Comp. Ex. 5 |
|---|---|---|---|---|---|
| Combined allyl and propenyl alcohol initiated polyglycol, wt % | 3 | 5 | 9 | 30 | 40 |

Figure 2:
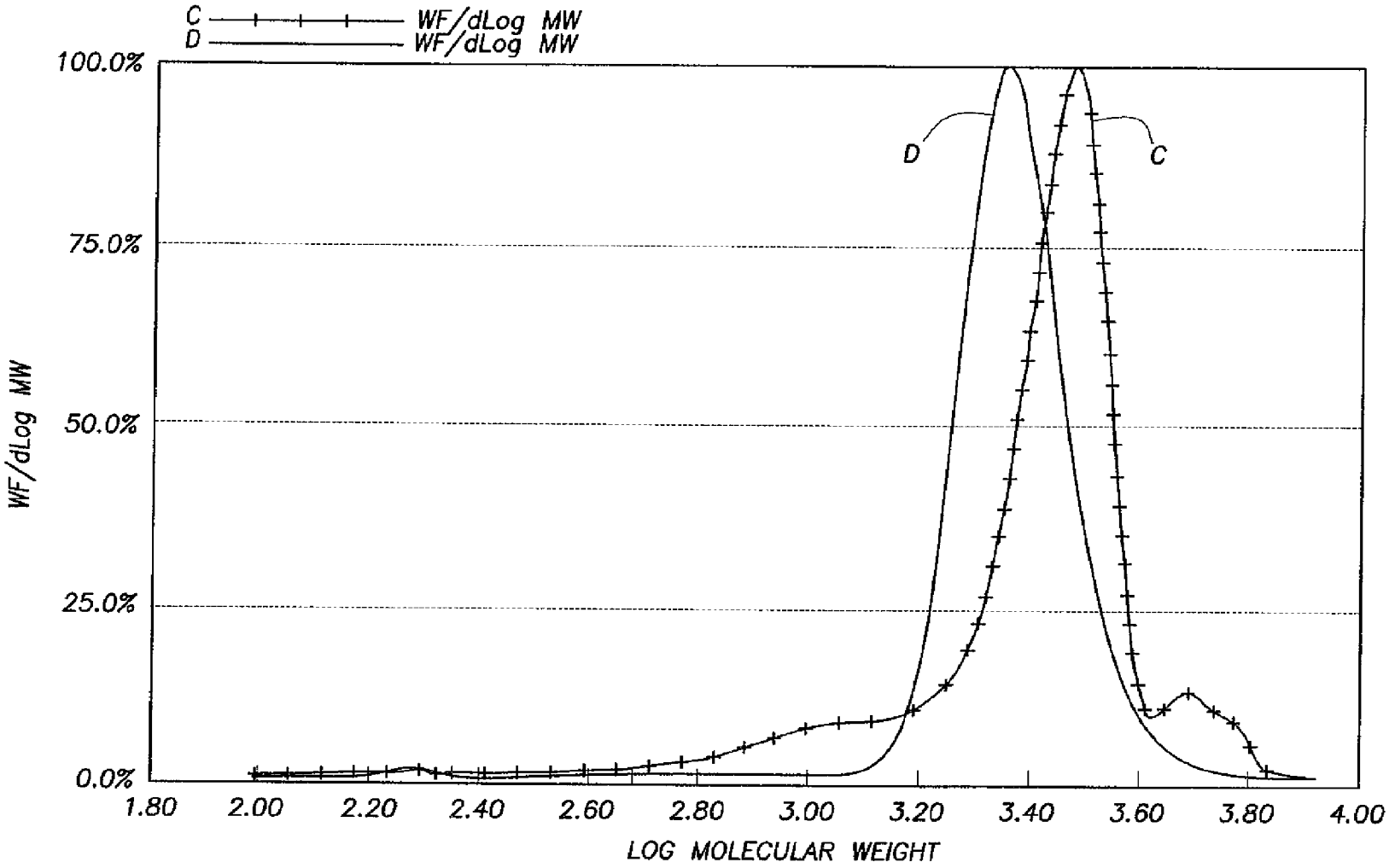
FIG. 2 is a graph of Log Weight Average Molecular Weight vs. a normalization of the concentration of a molecular weight fraction for each of Inventive Example 2 and Comparative Example 5.

Table 6 and FIGS. 1-2 illustrate the GPC data for Inventive Examples 1-2 and Comparative Examples 4-5. As can be seen in each of FIGS. 1-2, the Comparative Examples (which are KOH catalyzed) exhibit front end tails indicating the presence of unsaturated by products.

TABLE 6

| | Inv. Ex. 1 | Comp. Ex. 4 | Inv. Ex. 2 | Comp. Ex. 5 |
|---|---|---|---|---|
| Mn, daltons | 1.815 | 1.777 | 2.229 | 2.153 |
| Mw, daltons | 2.078 | 2.188 | 2.472 | 2.82 |
| Mz, daltons | 2.232 | 2.398 | 2.639 | 3.235 |
| Mw/Mn | 1.145 | 1.231 | 1.109 | 1.316 |
| Mp, daltons | 1.972 | 2.207 | 2.303 | 3.039 |

Test Methods

Test methods include the following:

Blend Stability Testing

The Oil Soluble PAG (OSP) of each of the Comparative and Inventive Examples was mixed with the hydrocarbon oils in the ratios 10/90, 25/75, 50/50, 75/25 and 90/10 (hydrocarbon oil to OSP by weight). Blending was conducted at ambient temperature using a conventional mechanical stirring mixing apparatus.

Blend stability of the compositions was assessed at 25° C., 80° C. and −15° C. by storing 200 mls of fluid in an oven, refrigerator or freezer for 1 week and visually noting the appearance of the compositions. Their appearance was noted and reported as clear or turbid or 2 phases. Only blends (i.e., compositions) that are clear are considered acceptable. As used herein, the term "clear" means translucent and free from any haze or suspended matter when visually observed.

Viscosity

Viscosity at 40° C. and viscosity at 100° C. were measured in accordance with ASTM D445.

Viscosity Index

Viscosity index was calculated in accordance with ASTM D2270.

Percent OH

Percent OH (% OH) was measured in accordance with ASTM D4274D.

Total Unsaturation

Total unsaturation was measured in accordance with ASTM D4671

Molecular Weight

The Molecular Weight Distribution of the samples was determined by means of room temperature GPC. The estimated applicable range of the used procedure is between 100 to 10000 Dalton.

Sample Preparation

120±20 mg of sample was weighed into a 20 mL vial and 10 mL Tetrahydrofuran (HPLC grade) was added. The vials were sealed with butyl rubber septum and the vials were shaken.

GPC Instrument Conditions

| GPC system | | Settings | |
|---|---|---|---|
| Degasser | Agilent G1379A; 2 channels in series | | |
| Pump | Agilent 1100 G1310A; isocratic | Flow (ml/min) | 1 |
| Autosampler | Agilent 1100 G1313A | Injection volume (μl) | 50 |
| Column oven | Shimadzu column box CTO-10A VP | Oven temperature (° C.) | 35 |
| Column | Series of 4 PL-Gel (7 mm × 30 cm × 5 □m) columns, each filled with PS/DVB of 50, 100, 500 or 1000 Å | | |
| RI Detector | Agilent 1100 Differential Refractive Index Detector | Peak width (min) | >0.2 |
| | | RI temperature (° C.) | 35 |
| UV/Vis Detector | Agilent 1100 G1315B | Wavelength (nm) | 240 |

Calibration

The GPC analysis was calibrated using a polyol mixture (1.5 wt-% in THF) with mol weights 6000, 4000, 2000 and 1000 dalton. The calculation was based on a broad standard method. The calibration parameters of this standard mixture are: Mw=2572 and Mn=1732 g/mol. The calculated molecular weights are only an indication of the real molecular weights because an accurate determination can only be carried out if the GPC system is calibrated with certified standards from the same type as the sample.

Molecular Weight Ratio

Actual molecular weight is calculated from % OH. Theoretical molecular weight is calculated based upon component quantities and assuming monol content based on fatty alcohol intake.

The present invention may be embodied in other forms without departing from the spirit and the essential attributes thereof, and, accordingly, reference should be made to the appended claims, rather than to the foregoing specification, as indicating the scope of the invention.

We claim:

1. A lubricant composition comprising:

a Group I, II, III or IV hydrocarbon oil; and a polyalkylene glycol, the polyalkylene glycol having been prepared by reacting a $C_8$-$C_{12}$ alcohol and a mixed butylene oxide/propylene oxide feed having a ratio of units derived from butylene oxide to the ratio of units derived from propylene oxide is from 3:1 to 1.3:1 using a double metal cyanide catalyst catalyzed oxyalkylation process, wherein the polyalkylene glycol has a kinematic viscosity of >100 cSt at 40° C.;

wherein the lubricant composition remains clear and shows no phase separation at temperatures equal to or greater than the pour point of the hydrocarbon oil.

2. The lubricant composition according to claim 1, wherein the lubricant composition comprises from 99.5 to 0.5 weight percent of the hydrocarbon oil and from 0.5 to 99.5 weight percent of the polyalkylene glycol.

3. The lubricant composition according to claim 1, wherein the hydrocarbon oil and the polyalkylene glycol are soluble with one another for at least one week under at least one temperature selected from temperatures from 80° C. to −15° C.

4. The lubricant composition according to claim 1, wherein the polyalkylene glycol has a carbon to oxygen ratio of at least 4:1.

5. The lubricant composition according to claim 1, wherein the polyalkylene glycol has a carbon to oxygen ratio that is from 4:1 to 6:1.

6. The lubricant composition according to claim 1, wherein the polyalkylene glycol has an unsaturation level <0.05 meq/g.

7. The lubricant composition according to claim 1, wherein, the polyalkylene glycol has a kinematic viscosity of >100 cSt at 40° C. and comprises a ratio of units derived from butylene oxide to units derived from propylene oxide from 3:1 to 1.3:1.

8. A method of preparing a lubricant composition comprising blending at least (a) a Group I, II, III, or IV hydrocarbon oil, and (b) a polyalkylene glycol prepared by reacting a $C_8$-$C_{12}$ alcohol and a mixed butylene oxide/propylene oxide feed having a ratio of units derived from butylene oxide to the ratio of units derived from propylene oxide from 3:1 to 1.3:1 in a double metal cyanide catalyst catalyzed oxyalkylation process, wherein the polyalkylene glycol has a kinematic viscosity of >100 cSt at 40° C., under conditions such that the hydrocarbon oil and the polyalkylene glycol are soluble with one another.

* * * * *